US006964993B2

(12) United States Patent
Leyrer et al.

(10) Patent No.: US 6,964,993 B2
(45) Date of Patent: Nov. 15, 2005

(54) PAPER COATING SLIP CONTAINING POLYVINYL ALCOHOL AS A PROTECTIVE COLLOID

(75) Inventors: Reinhold J. Leyrer, Dannstadt (DE); Harutyun Hanciogullari, Limburgerhof (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 24 days.

(21) Appl. No.: 10/847,865

(22) Filed: May 19, 2004

(65) Prior Publication Data

US 2004/0214941 A1 Oct. 28, 2004

Related U.S. Application Data

(63) Continuation of application No. 10/168,073, filed as application No. PCT/EP00/12274 on Dec. 6, 2000, now abandoned.

(30) Foreign Application Priority Data

Dec. 17, 1999 (DE) ..... 199 60 862

(51) Int. Cl.[7] ..... C08L 29/04

(52) U.S. Cl. ..... 524/503; 8/648; 252/301.21; 252/301.35; 524/459; 526/202

(58) Field of Search ..... 8/648; 252/301.21, 252/301.35; 524/459, 503; 526/202

(56) References Cited

U.S. PATENT DOCUMENTS

| | | | | |
|---|---|---|---|---|
| 2,460,998 | A | | 2/1949 | Nelson |
| 2,710,285 | A | | 6/1955 | Trusler |
| 2,851,423 | A | | 9/1958 | Gaunt |
| 3,400,008 | A | | 9/1968 | Bleyle et al. |
| 3,532,534 | A | | 10/1970 | Wolff |
| 3,726,820 | A | | 4/1973 | Bleyle et al. |
| 3,741,782 | A | | 6/1973 | Stewart et al. |
| 4,281,999 | A | | 8/1981 | Becker et al. |
| 4,350,788 | A | | 9/1982 | Ito et al. |
| 4,926,190 | A | | 5/1990 | Laver |
| 5,622,749 | A | * | 4/1997 | Rohringer et al. ..... 427/158 |
| 5,705,553 | A | | 1/1998 | Kuropka |
| 5,830,241 | A | | 11/1998 | Rohringer et al. |
| 6,123,996 | A | | 9/2000 | Larsson et al. |
| 6,174,586 | B1 | | 1/2001 | Peterson |

FOREIGN PATENT DOCUMENTS

| | | |
|---|---|---|
| EP | 0 044 995 | 7/1981 |
| EP | 0 624 687 | 11/1994 |
| EP | 0 863 163 | 9/1998 |
| GB | 1 039 540 | 8/1966 |
| GB | 1 429 648 | 3/1976 |

* cited by examiner

*Primary Examiner*—Judy M. Reddick
(74) *Attorney, Agent, or Firm*—Oblon, Spivak, McClelland, Maier, & Neustadt, P.C.

(57) ABSTRACT

A paper coating slip contains a polymer dispersed with polyvinyl alcohol as protective colloid in water (abbreviated to PVA-dispersed polymer).

14 Claims, No Drawings

PAPER COATING SLIP CONTAINING POLYVINYL ALCOHOL AS A PROTECTIVE COLLOID

CROSS-REFERENCE TO RELATED APPLICATIONS

The present application is a continuation of U.S. application Ser. No. 10/168,073 filed Jun. 17, 2002, now abandoned, which is the National Stage of International PCT application No. PCT/EP00/12274, filed Dec. 6, 2000.

BACKGROUND OF THE INVENTION

The present invention relates to a paper coating slip containing a polymer dispersed with polyvinyl alcohol as protective colloid in water (abbreviated to PVA-dispersed polymer)

DESCRIPTION OF THE BACKGROUND

Aqueous coating materials are often used for coating water-absorbing (absorptive) substrates. Paper coating slips are applied, for example, to base paper or cardboard and the resulting coating is dried. Excessively rapid water absorption by the substrate is generally disadvantageous for the production process. It makes it more difficult for the coating material to be uniformly distributed over the substrate and for a homogeneous coat to form. Moreover, excessively rapid water absorption leads to tearing of the paper web in the coating machine.

The ability of a coating material to prevent rapid absorption of water by absorptive substrates is referred to as water retention. Particularly in the continuous papermaking process, high water retention of the paper coating slips is desired. The coating of the base paper and homogeneous distribution as well as the adjustment of the coat thickness, for example with the aid of a doctor blade, take place with high mechanical loading of the paper web, at different points in the continuous process. Premature drying out of the coat not only has a disadvantageous effect on the quality of the end product but is also an obstacle to a trouble-free and rapid production process.

EP-A-627450 has disclosed polymers which are prepared in the presence of polyvinyl alcohol as a protective colloid and are used as thickeners. Polyvinyl alcohol-stabilized polymers are likewise described in EP-A-863163. The use of polyvinyl alcohol as an additive for aqueous paper coating slips and for dyes for textiles is described in EP-A-624687 and EP-A-44995.

SUMMARY OF THE INVENTION

It is an object of the present invention to improve the water retention of the paper coating slips. We have found that this object is achieved by the paper coating slips defined at the outset.

DETAILED DESCRIPTION OF THE PREFERRED EMBODIMENTS

The novel paper coating slip contains a polymer dispersed with polyvinyl alcohol (PVA) as a protective colloid (abbreviated to PVA-dispersed polymer).

PVA is understood as meaning a polymer which comprises at least 10, particularly at least 20, % by weight, based on the polymer, of groups of the formula

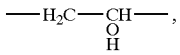

I which are derived from vinyl alcohol.

Usually, polyvinyl alcohols are obtained by hydrolyzing polyvinyl esters, in particular polyvinyl acetate. In addition to the structural units derived from vinyl alcohol, the PVAs may therefore also contain unhydrolyzed structural units derived from vinyl ester. The PVAs preferably contain from 30 to 100, particularly preferably from 50 to 100, % by weight of the formula I, from 0 to 70, particularly preferably from 0 to 50, % by weight of structural units derived from vinyl esters and, if required, from 0 to 40% by weight of other structural units.

Preferably, polyvinyl alcohol has a viscosity of from 0.1 to 100, in particular from 0.1 to 30, particularly preferably from 0.5 to 8, mPas, measured in a 4% strength by weight solution of the polyvinyl alcohol in water at 20° C. (according to DIN 53015).

The PVA-dispersed polymers can be prepared by polymerization of starting compounds (monomers) capable of radical polymerization in the aqueous phase in the presence of PVA.

Preferably, polymerization is carried out in the presence of at least about 0.5, particularly preferably at least 2, very particularly preferably at least 26, in particular at least 40, parts by weight, based on 100 parts by weight of monomers, of PVA. In general, not more than 250, preferably not more than 150, particularly preferably not more than 100, parts by weight, based on 100 parts by weight of monomers, are used.

Usually, the PVA is initially taken in the aqueous phase. In addition to PVA, other protective colloids or emulsifiers may also be used.

The polymerization can be carried out according to the generally known emulsion polymerization method.

In the emulsion polymerization, the monomers can be polymerized as usual in the presence of a water-soluble initiator, of the PVA and, if required, further protective colloids and emulsifiers at, preferably, from 30 to 140° C.

Suitable initiators are, for example, sodium persulfate, potassium persulfate and ammonium persulfate, tert-butyl hydroperoxides, water-soluble azo compounds or redox initiators, such as $H_2O_2$/ascorbic acid.

Additional protective colloids and emulsifiers are, for example, alkali metal salts of relatively long-chain fatty acids, alkyl sulfates, alkanesulfonates, alkylated arylsulfonates, alkylated biphenylethersulfonates, relatively long-chain fatty alcohols and the corresponding alkoxylated products of said sulfates, sulfonates and alcohols.

The PVA-dispersed polymer is preferably composed of the following monomers. The stated weights are based in each case on the total amount of the monomers of which the PVA-dispersed polymer is composed.

The PVA-dispersed polymer can be used as a binder. The PVA-dispersed polymer contains, as binders, preferably main monomers selected from $C_1$- to $C_{16}$-alkyl (meth) acrylates, vinylaromatics of up to 20 carbon atoms, vinyl esters of carboxylic acids with 1 to 20 carbon atoms, vinyl halides, ethylenically unsaturated nitriles, nonaromatic hydrocarbons having one or two conjugated double bonds or mixtures of these monomers. Examples are alkyl (meth) acrylates having a $C_1$–$C_{10}$-alkyl radical, such as methyl methacrylate, methyl acrylate, n-butyl acrylate, ethyl acrylate and 2-ethylhexyl acrylate.

Mixtures of the alkyl (meth)acrylates are also particularly suitable.

Examples of suitable vinyl esters of carboxylic acids of 1 to 20 carbon atoms are vinyl laurate, vinyl stearate, vinyl propionate and vinyl acetate.

Suitable vinylaromatic compounds of up to 20 carbon atoms are vinyltoluene, α-butylstyrene, 4-n-butylstyrene, 4-n-decylstyrene and preferably styrene. Examples of ethylenically unsaturated nitriles are acrylonitrile and methacrylonitrile.

Vinyl halides are chlorine-, fluorine- or bromine-substituted ethylenically unsaturated compounds, preferably vinyl chloride and vinylidene chloride.

Examples of nonaromatic hydrocarbons having one or two conjugated olefinic double bonds are butadiene, isoprene and chloroprene as well as ethylene.

In addition to the main monomers, PVA-stabilized polymers can also contain further monomers, for example hydroxyl-containing monomers such as hydroxyalkyl acrylates or monomers having alkoxy groups, as obtainable by alkoxylation of hydroxyl-containing monomers with alkoxides, in particular ethylene oxide or propylene oxide, monomers having acid or anhydride groups or salts thereof, e.g. (meth)acrylic acid, maleic acid and vinylsulfonic acid.

The PVA-stabilized polymer preferably comprises at least 20, particularly preferably at least 35, very particularly preferably at least 50% by weight of the main monomers.

The PVA-dispersed polymer may also be used as thickener.

When used as a thickener, the PVA-dispersed polymer preferably contains at least 5, particularly preferably at least 15, very particularly preferably at least 30, % by weight of monomers having at least one acid group (abbreviated to acid monomers). In general, the PVA-dispersed polymer contains not more than 80, particularly not more than 60, particularly preferably not more than 50, % by weight of the acid monomers.

When used as a thickener, the PVA-dispersed polymer may contain in particular the main monomers and further monomers described above in addition to the acid monomers.

When the PVA-dispersed polymer is used as a thickener, at least some of the acid groups are neutralized, preferably before the subsequent application. Preferably at least 30, particularly preferably from 50 to 100, mol % of the acid groups are neutralized. Suitable bases are volatile bases, such as ammonia, or nonvolatile bases such as alkali metal hydroxides.

The PVA-dispersed polymer obtained after the polymerization can, if desired, easily be spray-dried.

Flowable polymer powders having the abovementioned content of PVA protective colloid are obtained. The powders are readily redispersible in water and can therefore also be added in the form of a powder to the paper coating, slips.

The paper coating slip may contain a fluorescent or phosphorescent dye in addition to the PVA-dispersed polymer. Fluorescent dyes are preferred, in particular optical brighteners. Optical brighteners are fluorescent dyes which increase the brightness or, in the case of coated papers, for example, the whiteness.

Known optical brighteners are in particular stilbene derivatives.

In the present case, optical brighteners having a water solubility of at least 1 g, in particular at least 5 g, per liter of water (at 20° C.) are preferred.

In a preferred embodiment of the invention, the paper coating slip also contains, in addition to the PVA present as protective colloid, PVA which is dissolved in the aqueous phase. This additional PVA can, for example, be added at any time to the aqueous phase after the preparation of the PVA-dispersed polymer.

Based on the total amount of the PVA contained in the paper coating slip, preferably from 5 to 100, particularly preferably from 20 to 100, very particularly preferably from 30 to 100, % by weight of PVA are present as protective colloid in the PVA-dispersed polymer and from 0 to 95, particularly preferably from 0 to 80, very particularly preferably from 0 to 70, % by weight are present as PVA additionally dissolved in water. In particular, more than 50% by weight of the total amount of PVA or the total amount of PVA may be present as protective colloid.

It may also be used, for example, as aqueous coating or impregnating material, in particular as paper coating slip.

The paper coating slip contains in particular as components:

a) one or more binders
b) if required, a thickener
c) if required, a fluorescent or phosphorescent dye, in particular as an optical brightener
d) pigments or fillers at least one PVA-dispersed polymer being present as a binder a) or thickener b) in the composition.

Preferably, component b) is present. c), too, is present in a preferred embodiment when an optical brightener is desired.

Binders a) are preferably polymers which are capable of free radical polymerization and also comprise preferably at least 30, particularly preferably at least 50, % by weight of the abovementioned main monomers. In paper coating slips, these are in general $C_1$–$C_{16}$-alkyl (meth)acrylates or mixtures thereof with vinylaromatics, in particular styrene, or alternatively nonaromatic hydrocarbons having two conjugated double bonds, in particular butadiene, or mixtures thereof with vinylaromatics, in particular styrene.

Particularly in the case of paper coating slips, it has proven advantageous to combine binders of different compositions (binder and cobinder), as described in EP 14904.

Suitable thickeners b) in addition to polymers capable of free radical polymerization are conventional organic and inorganic thickeners, such as hydroxymethylcellulose or bentonite.

The thickener or one of the cobinders is preferably the PVA-dispersed polymer.

The pigment or filler d) is in general a white pigment, e.g. barium sulfate, calcium carbonate, calcium sulfoaluminate, kaolin, talc, titanium dioxide, zinc oxide, chalk or coating clay.

The paper coating slip preferably has the following composition by weight.

Paper coating slip:

a) from 1 to 40 parts by weight of binder (solid, i.e. without water)
b) from 0.1 to 10 parts by weight of thickener (solid, i.e. without water)
c) from 0.1 to 5 parts by weight of fluorescent or phosphorescent dye,
d) based on 100 parts by weight of the total amount of the pigments and fillers.

The total amount of the PVA present in the paper coating slip is preferably from 0.05 to 50, particularly preferably from 0.1 to 5, parts by weight, based on 100 parts by weight of the total amount of the components a) to d), of PVA. The preferred distribution over PVA as protective colloid and additionally dissolved PVA is as stated above.

Furthermore, on the basis of the above stated amounts of the components a) to d), the amount of the PVA initially taken in the emulsion polymerization is dependent on whether the PVA-dispersed polymer obtained was subsequently used as a binder or thickener. In the case of the binder, the amount of PVA desired in the subsequent paper coating slip can be reached with very small amounts of PVA protective colloid, since the amount of binder is much larger than customary amounts of thickener.

The paper coating slip may contain further components. For example, leveling agents, wetting assistants for the pigments, etc. are suitable.

The paper coating slips are aqueous paper coating slips. The water content can be adjusted according to the desired viscosity or leveling properties.

For the preparation of the paper coating slip, the components can be mixed in a known manner. The paper coating slips are suitable for coating, for example, paper or cardboard. The paper coating slip can then be applied by conventional methods to the papers or cardboard to be coated.

The coated papers or cardboard can be printed by conventional processes, for example offset, letterpress or gravure printing processes.

In the case of the paper coating slip, good water retention is observed. This prevents excessively rapid absorption of the water by the substrate, for example paper or cardboard, to be coated. The optical brightening, too, is improved.

EXAMPLES

A) Preparation of Paper Coating Slips

I Base Formulation:

A paper coating slip was prepared from the following components:

70.0 parts by weight of the pigment HYDROCARB 90, a finely divided chalk from Omya GmbH, Brohler Strasse 11a, D-50968 Cologne, 30.0 parts by weight of the pigment AMAZON 88, a finely divided clay from Kaolin International B. V. KAAI 54 DD, B-2030 Antwerp (97.5% strength), 0.1 part by weight of sodium hydroxide solution (25% strength)

0.3 part by weight of POLYSALZ S from BASF Aktiengesellschaft, D-67056 Ludwigshafen (45% strength solution of sodium polyacrylate), 10.0 parts by weight of ACRONAL® S360d from BASF (50% strength), a binder based on acrylates and styrene, 0.45 part by weight of BLANKOPHOR® PSG from Bayer AG, D-5090 Leverkusen 1 (45% strength), a stilbene derivative containing sulfonate and triazine groups, The solids content was brought to 67% by weight with water and the pH was brought to 8.9–9.1 with sodium hydroxide solution.

II Addition of a Cobinder to the Base Formulation a) 1.5 parts by weight, based on 100 parts by weight of pigment, of ACROSOL® B 37 D (solid), a polyacrylate from BASF, were added.

b) 1.5 parts by weight (solid), based on 100 parts by weight of pigment, of a mixture of ACROSOL B37D and polyvinyl alcohol (PVA) were added.

Preparation of the Mixture:

300 g of 30% strength ACROSOL B37D were introduced into a 11 glass beaker and stirred with an anchor stirrer (120 rpm) at room temperature. At the same time, 180 g of a 15% strength polyvinyl alcohol, (Moviol MOVIOL 4/88, Hoechst AG, 67 mPas, 10% strength/pH 5.3 solution in demineralized water) were prepared in a separate vessel with gentle heating, added to the 11 glass beaker and stirred for another 10 minutes. For stabilization, 10 ppm of the biocide KATHON LXE were stirred in.

c) 0.5 part by weight (solid) based on 100 parts by weight of pigment, of PVA-dispersed polymer was added.

Preparation of the PVA-Dispersed Polymer 556 g of demineralized water, 75 g of polyvinyl alcohol (Moviol MOVIOL 4/88) and 1.25 g of the iron catalyst DISSOLVINE E-FE-13 (1% strength) were initially taken in a stirred apparatus consisting of a 2 liter four-necked flask having a paddle stirrer (180 rpm), reflux condenser, internal thermocouple and a metering station and were heated to 75° C. The polyvinyl alcohol dissolved during the heating up.

5 ml of a 2.5% strength sodium persulfate solution were added to this solution at 75° C. for 5 minutes. The monomer mixture (100 g of acrylonitrile, 100 g of ethyl acrylate, 50 g of acrylic acid, 1.5 g of tertiary dodecyl mercaptan, 16,67 g of Steinapol STEINAPOL NLS (sodium laurylsulfate) and 240 g of demineralized water), 45 g of 2.5% strength sodium persulfate solution and 47 g of a 0.8% strength ascorbic acid solution (LUTAVIT C) were then metered in uniformly at 75° C. with further stirring in the course of 3 hours. Thereafter, the reaction mixture was stirred for a further 15 minutes at 75° C. and then brought to room temperature. At room temperature, 20 g of a 2.5% strength hydrogen peroxide solution and 20 g of a LUTAVIT C solution were metered in uniformly in the course of 1 hour. An aqueous polymer dispersion having a solids content of 25% was obtained.

III Addition of a Thickener to the Base Formulation a) 1.5 parts by weight, based on 100 parts by weight of pigment (solid), of STEROCOLL® PR 8749 X (solid), a thickener based on acrylates, were added.

b) 0.3 part by weight, based on 100 parts by weight of pigment, of a PVA-dispersed polymer (solid) was added as a thickener.

Preparation of the PVA-Dispersed Polymer

The experimental setup corresponded to that under IIc. 730 g of demineralized water and 90 g of RHODOVIOL R 4/20 (Rhône-Poulenc GmbH 85 mPas, 10% strength/pH 5.3) were initially taken and heated to 85° C. and the mixture was stirred at 85° C. for 5 minutes. Thereafter, with further stirring at 85° C., the monomer mixture (100.8 g of ethyl acrylate, 19.8 g of acrylic acid, 69.4 g of methacrylic acid, 0.18 g of tertiary dodecyl mercaptan, 6 g of Steinapol STEINAPOL NLS (sodium laurylsulfate) and 176 g of demineralized water), and 32.4 g of a 1% strength sodium persulfate solution were metered in uniformly in the course of 2 hours and 43 g of 0.25% strength ascorbic acid solution (LUTAVIT C) in the course of 2.25 hours. The reaction mixture was then brought to room temperature. At room temperature, 0.09 g of DISSOLVINE E-FE-13 (1% strength) and 6 g of a 3% strength hydrogen peroxide solution were added for chemical aftertreatment. 27 g of a 1% strength LUTAVIT C solution were then metered in over 30 minutes. An aqueous polymer dispersion having a solids content of 20% was obtained.

c) 0.3 part by weight (solid) based on 100 parts by weight of pigment, of a mixture of PVA-dispersed polymer and additional PVA was added.

Preparation of the Mixture:

The procedure corresponds to III b, with the following modifications:

802 g of demineralized water and 54 g of polyvinyl alcohol RHODOVIOL R 4/20 were initially taken and heated to 85° C.

After the end of the ascorbic acid feed, a further 64 g of RHODOVIOL R 4/20 were added and were rinsed in 50 g of demineralized water.

IV Addition of a PVA-Stabilized Cobinder in Powder Form to the Base Formulation.

0.5 part by weight, based on 100 parts by weight of pigment, of the powder was added.

Preparation of the Powder

The preparation was carried out according to IIc, with the following modifications:

Modification:

732 g of demineralized water and 50 g of polyvinyl alcohol RHODOVIOL R 8/20-Rhône-Poulenc GmbH, 179 mPas, 10% strength/pH 5.6) were initially taken and were heated to 75° C. The monomer mixture is metered in without Steinapol STEINAPOL NLS (sodium laurylsulfate). An aqueous polymer dispersion which has a solids content of 25% was obtained and was subsequently spray-dried. The spray-dried powder had a residual moisture content of about 2% and an unlimited shelf-life.

was multiplied by 1250. The result is the stated amount of water, in g/m$^2$.

The smaller the amount released, the better is the water retention of the paper coating slip. (cf. Table 1).

Determination of the Optical Brightener

The optical brightening was determined using an Elrepho 2000 spectrophotometer from Datacolor GmbH (D-45769 Marl).

The papers to be tested were stacked in groups of 4. 5 measurements were carried out by paper sample.

The values stated in Table 1 are a measure of the brightening.

The higher the value, the greater is the brightening.

| Example | Parts by weight of PVA, based on 100 parts by weight of the added dispersion[1] (solid) | Parts by weight of added dispersion, based on 100 parts by weight of pigment | Parts by weight of PVA, based on 100 parts by weight of pigment (solid) | optical brightening | Water retention amount of water released, in g/m$^2$ |
|---|---|---|---|---|---|
| IIa* | 0 | 1.5 | 0.00 | 5.3 | 158 |
| IIb* | 30 | 1.5 | 0.45 | 6.2 | 164 |
| IIc | 30 | 0.5 | 0.15 | 6.2 | 109 |
| IIIa* | 0 | 1.5 | 0.00 | 5.0 | 126 |
| IIIb | 50 | 0.3 | 0.15 | 6.0 | 126 |
| IIIc | 65 | 0.3 | 0.20 | 6.0 | 131 |
| IV | 20 | 0.5 | 0.10 | 5.8 | 129 |

*for comparison

[1]added dispersion is understood in each case as meaning cobinder or thickener dispersion added to the base formulation in Examples IIa to IV B. Coating of the Papers and Test Results Production of the Coated Paper The base paper used was wood-free coating paper from Scheufelen GmbH+Co.KG, D-73250 Lenningen, having a basis weight of 70 g/m$^2$. The paper coating slip was applied on one side in a dry coat thickness of 12 g/m$^2$ on a laboratory coating machine with blade. The applied moist coat was dried by means of IR lamps.

Determination of the Water Retention According to Gradek

The water retention was measured in a AA-GWR pressure filtration apparatus from Abo Akademi-Gravimetric Water Retention, which was obtained from OY Gradek AB, Mariantie 9, SF-02700 Kauniainen, Finland. The filter used was a 100/Pk polycarbonate membrane, 5.0 $\mu$m-pore size, 47 mm diameter, from Osmonics Inc., which was obtained from Infiltec GmbH, Alte Rheinhäuser Straβe 8, D-67346 Speyer/Rhine. The paper used was ashless Schwarzband filter paper, 90 mm diameter, from Schleicher & Schuell, Postfach 4, D-3354 Dassel.

The apparatus was connected to a compressed air line and brought to a pressure of 4 bar. Five weighed filters stapled together were placed on the rubber sheet, it being necessary to ensure that the 5$^{th}$ filter is still dry after measurement. If not, the number should be increased to 8 or 10. These are followed by a slightly projecting polycarbonate membrane and a metal cylinder with a rubber seal at the top. The stopper was closed by means of a lever. A pressure of 0.5 bar was established by pulling out the pressure-adjusting knob. About 5 ml of the paper coating slip were introduced into the metal cylinder. 0.5 bar was applied for 50 seconds. The wet filter papers were weighed again. The moisture absorption

We claim:

1. A paper coating slip, comprising:

a) from 1 to 40 parts by weight of a binder, b) from 1 to 10 parts by weight of a thickener, the parts by weight of components (a) and (b) based on the solids contents of components a) and b), wherein a PVA dispersed polymer prepared by copolymerizing at least 20% by wt of at least one main monomer selected from the group consisting of $C_{1-16}$-alkyl (meth)acrylates, a vinyl aromatic compound of up to 20 carbon atoms, vinyl esters of carboxylic acids of 1 to 20 carbon atoms, a vinyl halide, an ethylenically unsaturated nitrile, a non-aromatic hydrocarbon of one or two double bonds and mixtures thereof, in the presence of 0.5 to 250 parts by weight of polyvinyl alcohol, based on 100 parts by weight of monomer polymerized, is a component of binder a) or thickener b), c) from 0.1 to 5 parts by weight of a fluorescent or phosphorescent dye, and d) one or more pigments, fillers or combinations thereof to complete the composition with the total amounts of components a) to c) based on 100 parts by weight of component d).

2. The paper coating slip as claimed in claim 1, wherein the PVA dispersed polymer is a component of the thickener.

3. The paper coating slip as claimed in claim 1, wherein the PVA dispersed polymer as a component of the thickener, contains from 5% by wt to 80% by wt of acid monomer.

4. The paper coating slip as claimed in claim 3, wherein the PVA dispersed polymer as a component of the thickener, contains from 15% by wt to 60% by wt of acid monomer.

5. The paper coating slip as claimed in claim 1, wherein the polyvinyl alcohol comprises at least 10% by weight of polymerized groups —$H_2C$—CH(OH)—.

6. The paper coating slip as claimed in claim 1, wherein the polyvinyl alcohol has a viscosity ranging from 1 to 100 mPas, measured according to DIN 53015 in a 4% strength by weight aqueous solution of the polyvinyl alcohol at 20° C.

7. The paper coating slip as claimed in claim 1, comprising from 0.05 to 50 parts by weight of said polyvinyl alcohol, based on 100 parts by weight of the total amount of the components a), b), c) and d).

8. A method of preparing a paper coating slip composition, comprising:

(co)polymerizing at least 20% by wt of at least one monomer selected from the group consisting of $C_{1-16}$-alkyl (meth)acrylates, a vinyl aromatic compound of up to 20 carbon atoms, vinyl esters of carboxylic acids of 1 to 20 carbon atoms, a vinyl halide, an ethylenically unsaturated nitrile, a non-aromatic hydrocarbon of one or two double bonds and mixtures thereof, in the presence of 0.5 to 250 parts by weight of polyvinyl alcohol, based on 100 parts by weight of monomer polymerized, by free radical initiation, thereby preparing a PVA-dispersed polymer; and combining the PVA-dispersed polymer with a binder formulation of a) of an amount of 0.1 to 40 parts by weight composition or a thickener formulation b) of an amount of 0.1 to 10 parts by weight of the composition, and completing the paper slip composition with c) from 0.1 to 5 parts by weight of a fluorescent or phosphorescent dye, and d) pigments and fillers, the total amounts of components a) to c) based on 100 parts by weight of component d).

9. The method as claimed in claim 8, wherein the polyvinyl alcohol comprises at least 10% by weight of polymerized groups —$H_2C$—CH(OH)—.

10. The method as claimed in claim 8, wherein the polyvinyl alcohol has a viscosity ranging from 1 to 100 mPas, measured according to DIN 53015 in a 4% strength by weight aqueous solution of the polyvinyl alcohol at 20° C.

11. The method as claimed in claim 8, wherein the (co)polymerization reaction is conducted at 30 to 140° C.

12. The method as claimed in claim 8, wherein the initiator is a persulfate, a hydroperoxide, a water-soluble azo compound or a redox initiator.

13. A method for coating paper and/or cardboard, comprising:

coating paper or cardboard with the paper coating slip claimed in claim 1.

14. A paper or cardboard coated with the paper coating slip as claimed in claim 1.

* * * * *